US006071073A

United States Patent [19]

Maier

[11] Patent Number: 6,071,073

[45] Date of Patent: Jun. 6, 2000

[54] METHOD OF FABRICATING A TURBINE INLET CASING AND THE TURBINE INLET CASING

[75] Inventor: William C. Maier, Almond, N.Y.

[73] Assignee: Dresser-Rand Company, Corning, N.Y.

[21] Appl. No.: 09/078,981

[22] Filed: May 14, 1998

[51] Int. Cl.[7] ..... F01D 17/14; F01D 17/18

[52] U.S. Cl. ..... 415/150; 415/155; 415/151; 415/159; 415/202; 29/525.01; 29/527.6; 29/558; 29/888.02

[58] Field of Search ..... 415/150, 151, 415/155, 157, 159, 167, 185, 186, 202; 239/553, 553.3, 553.5; 137/271, 884; 29/525.01, 527.6, 557, 558, 888, 888.02

[56] References Cited

U.S. PATENT DOCUMENTS

| | | | |
|---|---|---|---|
| 987,842 | 3/1911 | Waller | 415/155 |
| 2,147,874 | 2/1939 | Zetterquist | 415/155 |
| 2,855,178 | 10/1958 | Forsythe et al. . | |
| 2,978,223 | 4/1961 | Keeney et al. | 415/151 |
| 3,612,712 | 10/1971 | Kanger et al. . | |
| 3,677,658 | 7/1972 | Dinenno, Jr. et al. | 415/151 |
| 4,111,598 | 9/1978 | Kasuya . | |
| 4,247,250 | 1/1981 | Lipe et al. . | |
| 4,421,454 | 12/1983 | Wosika . | |
| 4,435,121 | 3/1984 | Wosika . | |
| 4,456,032 | 6/1984 | Straslicka | 415/155 |
| 4,592,699 | 6/1986 | Maierbacher . | |
| 4,642,025 | 2/1987 | Heiniger et al. . | |
| 4,840,537 | 6/1989 | Silvestri, Jr. . | |
| 5,215,436 | 6/1993 | Puzyrewski . | |
| 5,472,143 | 12/1995 | Bartels et al. | 239/553 |
| 5,823,743 | 10/1998 | Giddings | 415/155 |

FOREIGN PATENT DOCUMENTS

| | | | |
|---|---|---|---|
| 61-218706 | 9/1986 | Japan | 415/151 |
| 381119 | 9/1932 | United Kingdom | 29/557 |

*Primary Examiner*—Christopher Verdier
*Attorney, Agent, or Firm*—Nixon & Peabody LLP

[57] ABSTRACT

A method for fabricating a turbine inlet casing has several steps. Providing a prismatic block having an upstream face, a downstream face, and a central axis perpendicular to the upstream and downstream faces. Cutting a circular shaft clearance opening through the block, concentric with the central axis. Cutting an inlet plenum through the block along the central axis. The inlet plenum is positioned towards an outer edge of the block. Cutting one or more distribution ports through the block along the central axis. These ports begin close to the inlet plenum and end at annular segments which are concentric with the central axis and at a radial position coincident with the turbine flowpath. The annular ends (of the distribution ports) are spaced circumferentially apart from each other. Cover plates are attached to the upstream and/or downstream faces of the block over the passages and ports. Connecting holes are made between the inlet plenum and the distribution ports. A turbine inlet hole is made to provide an ingress path for motive fluid to the inlet plenum. The block can then be split along a line perpendicular to the central axis and extra casing extensions can be added to the upstream and downstream faces to provide for interfacing with other parts of the turbine.

23 Claims, 6 Drawing Sheets

METHOD OF FABRICATING A TURBINE INLET CASING AND THE TURBINE INLET CASING

FIELD OF THE INVENTION

This invention relates generally to a method for fabricating a turbine inlet casing and the turbine inlet casing.

BACKGROUND OF THE INVENTION

An inlet casing is where a motive fluid, such as steam, initially comes into a turbine. Typically, the inlet casing has one or more passages which direct the motive fluid to a first stage stationary component, such as a nozzle ring. The nozzle ring is a ring shaped plate attached to the downstream face of the inlet casing directly upstream of a first stage rotational component. The nozzle ring contains nozzle passages which accelerate and redirect the flow of the motive fluid. The first stage rotational component is a wheel with a plurality of buckets, termed a bucket row, attached to its outer circumference. The wheel of each stage is co-axially mounted to a shaft which rotates about a first axis, also referred to as the rotational axis of the turbine, and is positioned to receive the motive fluid from the passages in the nozzle ring.

Typically, casting patterns and tooling molds are used to form one or more castings which comprise the inlet casing with distribution ports. If the shape is too complex, then multiple castings are bolted or welded together to form the inlet casing. The inlet casing is then adapted to the particular turbine application. Alternatively, a fabrication of plates and tubes is welded and fitted together to form the inlet casing. This alternative method is labor intensive and time consuming.

Ideally, each inlet casing would be customized for each turbine application. Unfortunately, the process of redesigning tooling to make a customized casting for an inlet casing for each particular turbine application or to weld and fit plates together to form an inlet casing is time consuming and expensive. As a result, rather than manufacturing a new inlet casing, existing cast inlet casings with less than ideal dimensions are used which ultimately reduces the performance and efficiency and increases the cost of the turbine. To try and accommodate the various turbine applications in a timely manner, manufacturers often carry large inventories of pre-cast inlet casings or casing component castings which is an expensive practice.

SUMMARY OF THE INVENTION

The inlet casing in accordance with one embodiment of the present invention includes a block, one or more distribution ports, and at least one cover plate. The block has an upstream face and a downstream face and also has a shaft opening extending from the upstream face. Each of the distribution ports extends towards and is spaced from the shaft opening and extends through the block from the upstream face to the downstream face. The block has at least one connecting hole to each of the distribution ports. Upstream and downstream cover plates are attached to the upstream and downstream faces of the block to cover the distribution ports. The inlet casing may also include an inlet plenum extending through the block from the upstream face to the downstream face. If the inlet casing has an inlet plenum, the connecting holes connect the inlet plenum to the distribution ports and the upstream and downstream cover plates also cover the inlet plenum.

A method for fabricating a turbine inlet casing in accordance with one embodiment of the present invention has the following steps. Providing a prismatic block having an upstream face, a downstream face, and a central axis perpendicular to the upstream and downstream faces. Cutting a circular shaft clearance opening through the block, concentric with the central axis. Cutting an inlet plenum through the block along the central axis. The inlet plenum is positioned towards an outer edge of the block. Cutting one or more distribution ports through the block along the central axis. These ports begin close to the inlet plenum and end at annular segments which are concentric with the central axis and at the radial position of the turbine flowpath. If multiple distribution ports are used, then their annular ends are spaced circumferentially apart from each other. Cover plates are attached to the upstream and downstream faces of the block over the passages and ports. Connecting holes are made between the inlet plenum and the distribution ports. A turbine inlet hole is made to give an ingress path for the fluid to the inlet plenum. The block is then split along a line perpendicular to the central axis. Extra casing extensions can then be added to the upstream and downstream faces to provide room for bolting or shaft packing and attachment to the rest of the turbine case.

A method for fabricating a turbine inlet casing in accordance with another embodiment of the present invention has several steps including: providing a prismatic block having an upstream face and a downstream face; cutting a shaft opening through the block from the upstream face to the downstream face; cutting one or more distribution ports through the block, each of the distribution ports extending towards and spaced from the shaft opening and extending through the block from the upstream face to the downstream face; cutting at least one connecting hole in the block to each of the distribution ports; and attaching cover plates to the upstream and downstream faces of the block to cover the distribution ports. The method may also include the step of cutting an inlet plenum in the block, the inlet plenum extending through the block from the upstream face to the downstream face, wherein each of the connecting holes connects the inlet plenum to the distribution ports and the cover plates also cover the inlet plenum.

The method for fabricating a turbine inlet casing and resulting apparatus provide a number of advantages, including the ability to customize an inlet casing including its distribution ports for any particular turbine application, rather than the prior approach of making the turbine design fit into an existing pre-cast inlet casing because of the large costs associated with developing new castings or of fabricating an inlet casing from plates. Additionally, the method allows a manufacturer to build a broad range of customized inlet casings with the same raw material. As a result, the manufacturer does not need significant inventories that would be required with prior pre-cast inlet casings. Further, with the method an optimized design for the inlet casing can be obtained each time resulting in improved performance and efficiency. Even further, with the method the distribution ports are all formed in a radial plane and thus have a minimal axial length which leads to important cost and performance benefits.

DETAILED DESCRIPTION

Figure 1A:
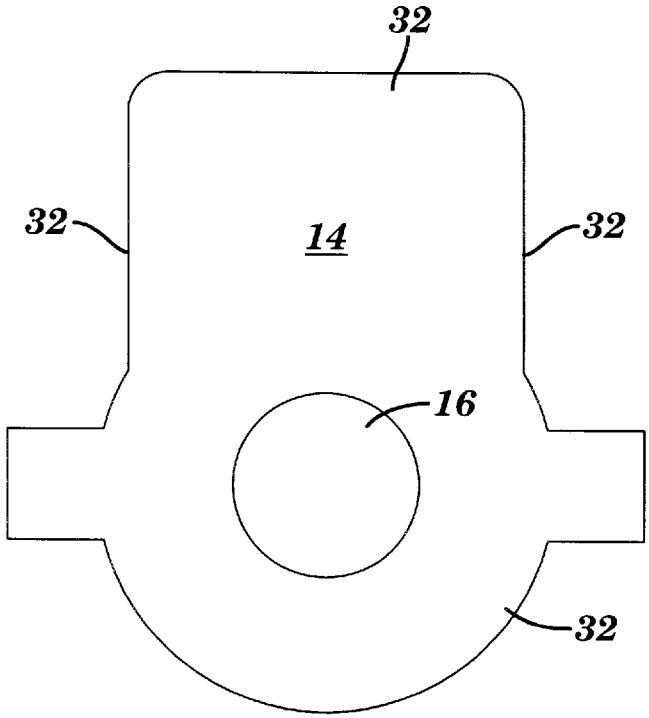
FIG. 1A is a front view of a block used to form an inlet casing in accordance with one embodiment of the present invention.
Figure 1B:
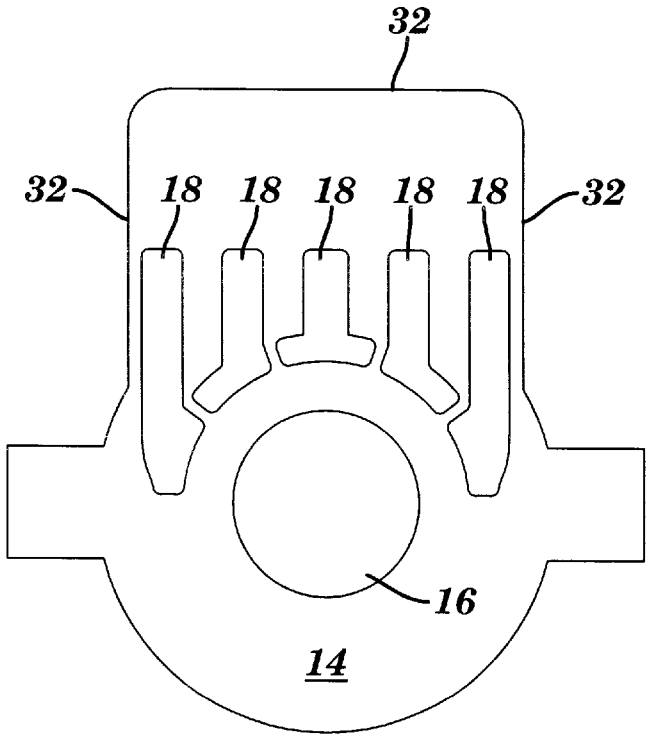
FIG. 1B is a front view of the block with a shaft opening and distribution ports.
Figure 1C:
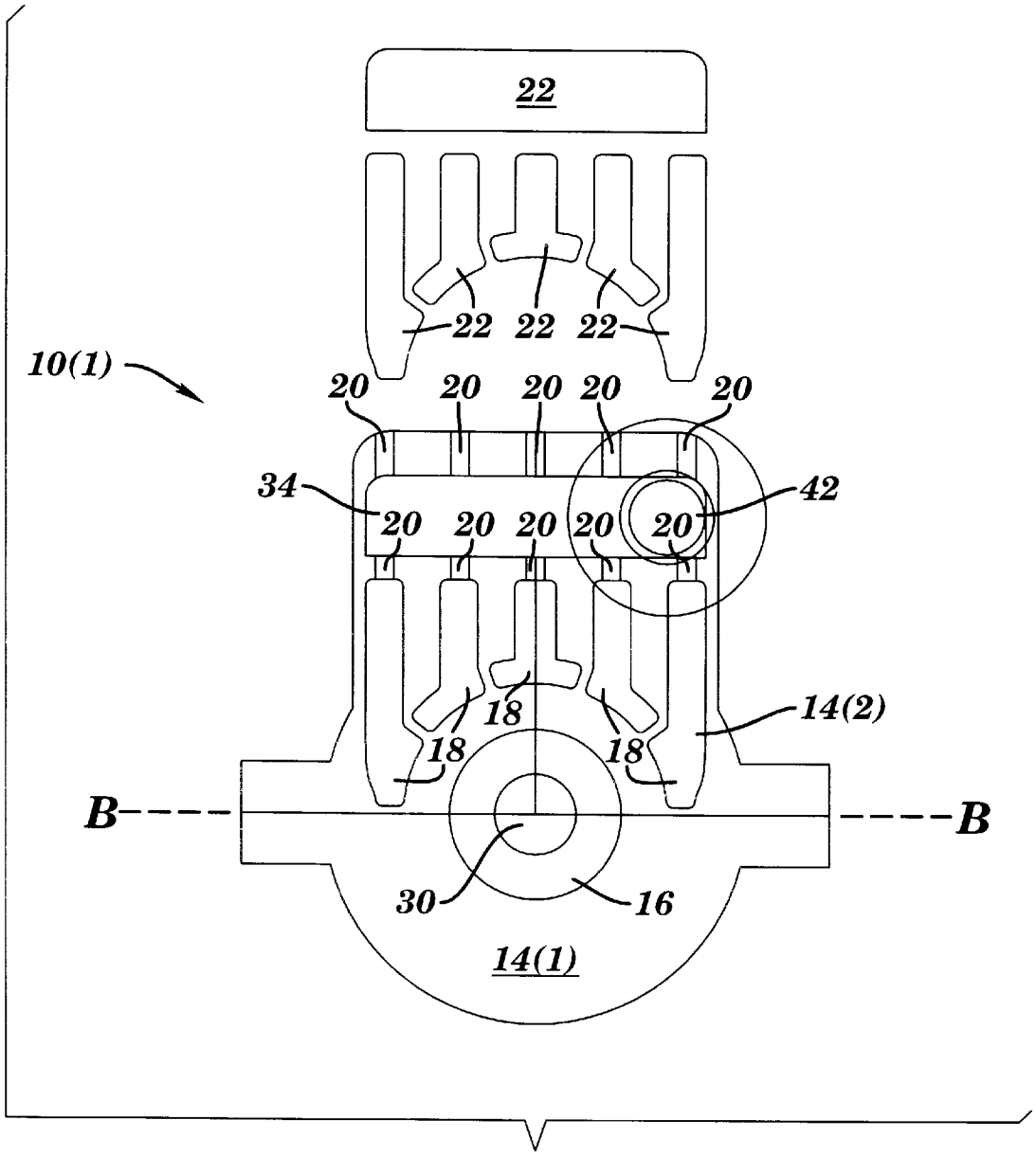
FIG. 1C is a front view of the block with an inlet plenum and cover plates for covering the inlet plenum and the distribution ports.

A method for fabricating an inlet casing 10(1) for a turbine in accordance with one embodiment of the present invention is illustrated in FIGS. 1A–1C. The method has several steps including providing a block 14, cutting a shaft opening 16 in the block 14, cutting at least one inlet plenum 34 into the block 14, cutting one or more distribution ports 18 into the block 14, cutting at least one connecting hole 20 in the block 14 between the inlet plenum 34 and each distribution port 18. The inlet casing 10(1) includes block 14, one or more distribution ports 18, and at least one inlet plenum 34, one upstream cover plate 22, and one downstream cover plate 24. Although FIGS. 1–3 show embodiments of the present invention for a horizontally split, axial flow turbine, the present invention could also be used on other turbines, such as radial flow or radially split turbines. The method of fabricating the inlet casing 10 for a turbine 12 and the inlet casing 10 provide a number of advantages including the ability to customize the shape and size an inlet casing 10 and its motive fluid distribution system 18 for each turbine application.

In the particular embodiment, shown in FIGS. 1A–1C, block 14 has an upside down, keyhole shape, although the shape of the block 14 can vary as needed or desired. Preferably, the block 14 is made of metal, such as ASTM A516 carbon steel plate, although other types of materials can be used for the block 14 as needed or desired.

Each of the constituent parts of the turbine 12, including the block 14 and the inlet casing 10, have an upstream and a downstream face or side 26 and 28. The upstream face 26 is the side of a part facing the direction from which the motive fluid is coming and the downstream face 28 is the side of a part where the motive fluid leaves the part. In an axial flow turbine 12, the upstream and downstream faces 26 and 28 are arrayed axially with respect to a rotational or first axis A—A about which a shaft 30 of the turbine 12 rotates. The block 14 also has a plurality of side surfaces 32, although the outer shape of the block and the number of side surfaces 32 can vary as needed or desired. One of the advantages of the invention is that the block 14 can be customized to fit a variety of different turbines 12. As a result, the manufacturer only needs to keep a supply of one set of uncut blocks 14 in inventory and does not need to keep a large inventory of different kinds of pre-cast inlet casings.

Once the block 14 is provided, typically the shaft opening 16 is cut through the block 14 from the upstream face 26 to the downstream face 28. The shaft opening 16 extends along the rotational or first axis A—A. The shaft opening 16 is cut to have a larger circumference than the shaft 30 to provide rotational clearance for the shaft 30. Any technique, such as flame cutting or drilling, can be used to cut the shaft opening 16. The shaft opening 16 may be omitted if the turbine has an overhung rotor with no inlet end shaft projection.

Next, distribution ports or passages 18 are cut into the block 14 to extend in from the inlet plenum 34 in a somewhat radial direction with respect to the rotational axis A—A and toward the radial position of the turbine flow path. The distribution ports 18 are spaced from each other and also from the shaft opening 16. The inner ends of the distribution ports 18 are annular segments generally aligned with the turbine flow path. Like the shaft opening 16, the distribution ports 18 are cut to extend through the block 14 from the upstream face 26 to the downstream face 28 and have a prismatic shape in this particular embodiment. Although in this particular embodiment the distribution ports extend through the block 14, the distribution ports 18 may also be machined into the block 14 to extend in from either the upstream face 26 or downstream face 28, but not all the way through block 14. Any technique, such as flame cutting, can be used to cut each of the distribution ports 18.

Figure 2A:
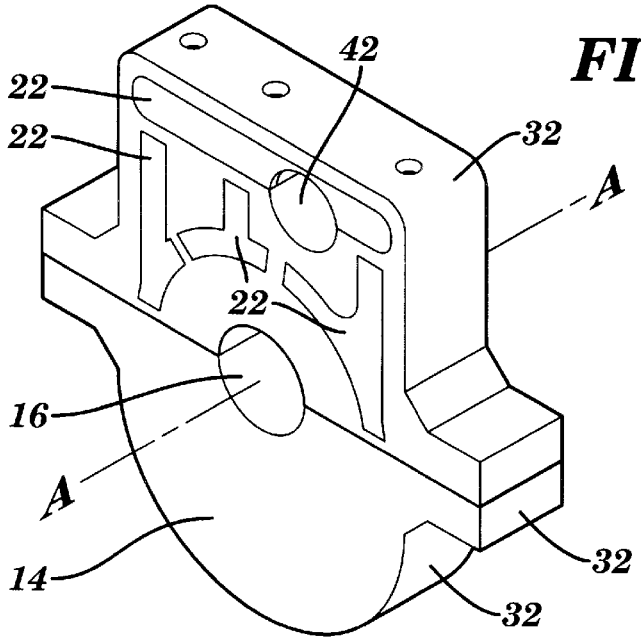
FIG. 2A is an upstream perspective view of an inlet casing in accordance with another embodiment of the present invention.
Figure 2B:
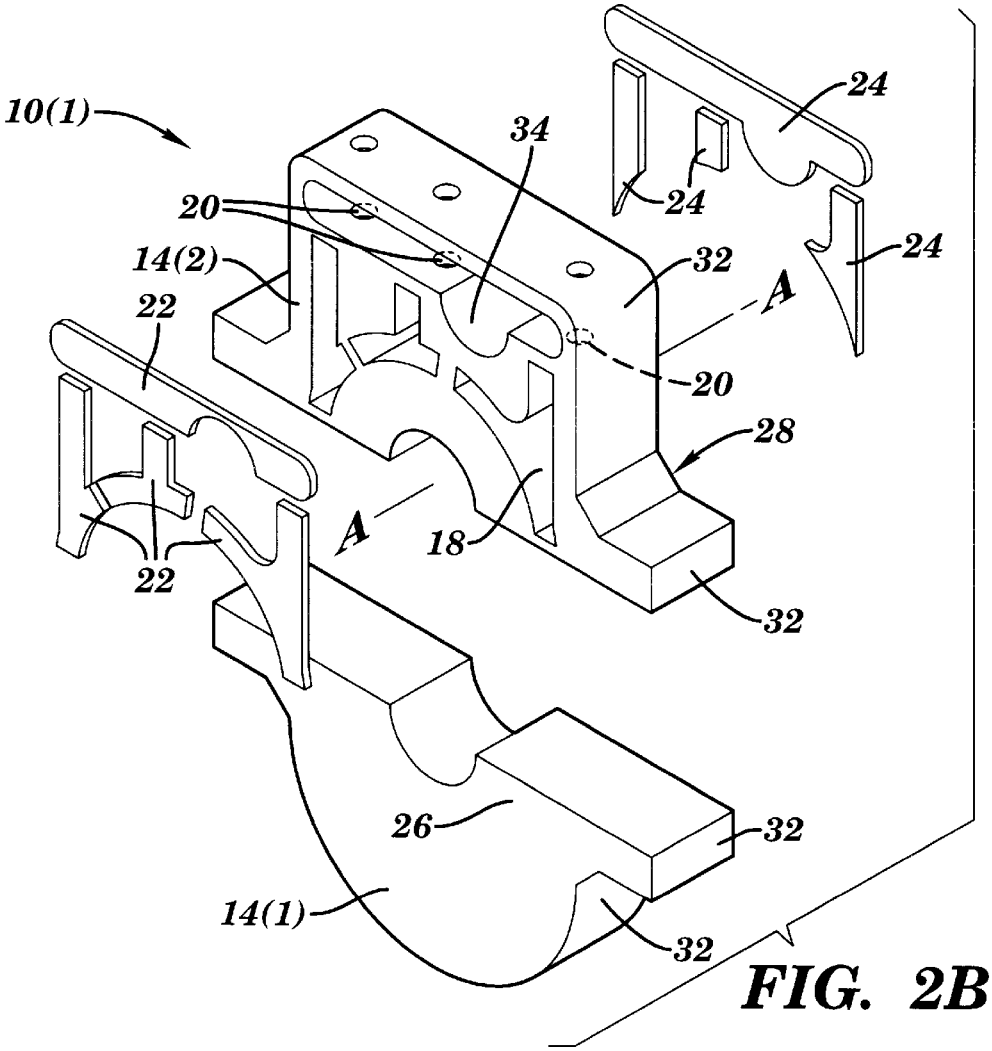
FIG. 2B is an exploded, upstream perspective view of the inlet casing shown in FIG. 2A.
Figure 2C:
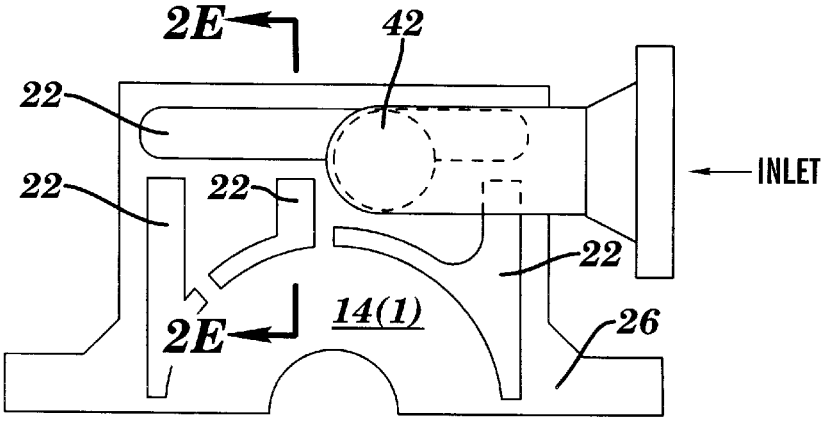
FIG. 2C is an upstream view of the upper half of the inlet casing.
Figure 2D:
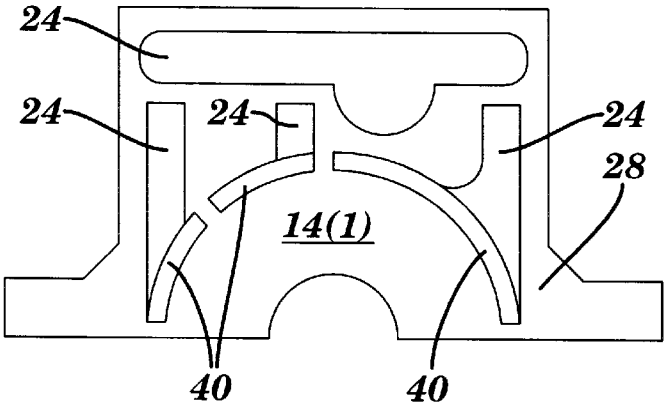
FIG. 2D is a downstream of the upper half of the inlet casing.
Figure 2E:
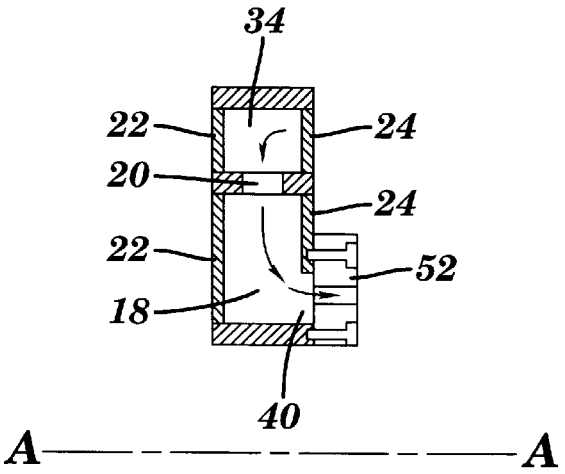
FIG. 2E is a cross-sectional view of the upper half of the inlet casing taken along line 2E—2E in FIG. 2C.
Figure 3A:
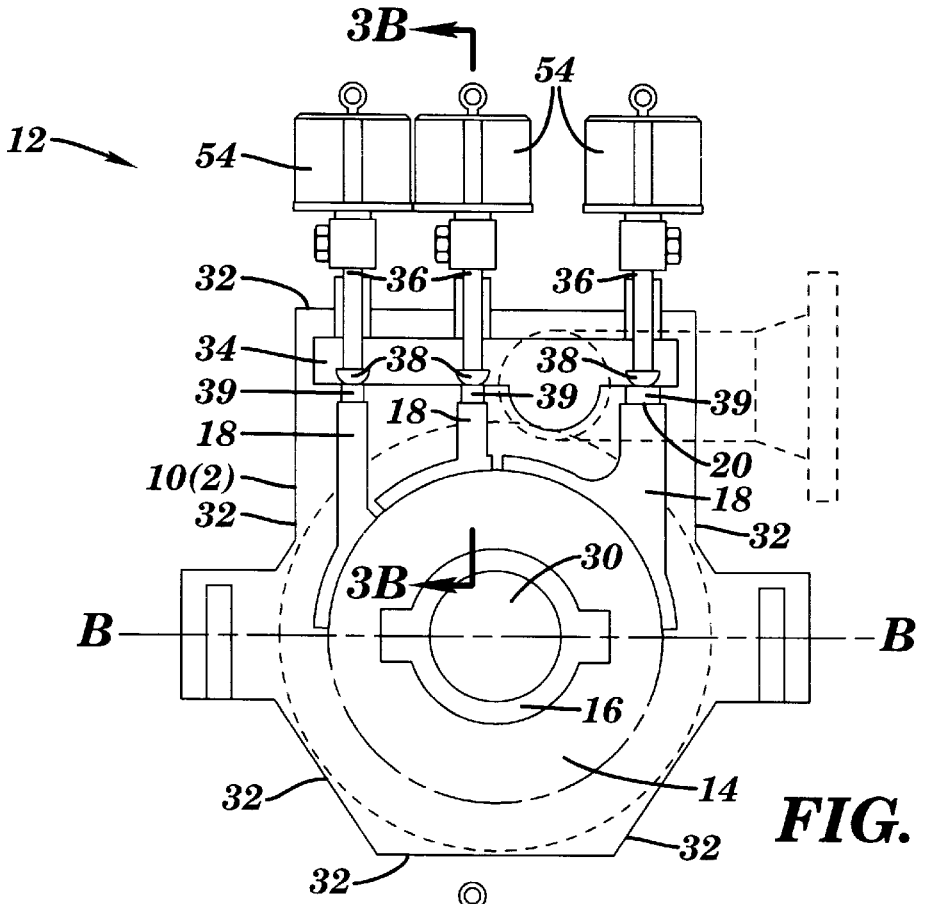
FIG. 3A is a cross-sectional view of the inlet casing in a turbine.
Figure 3B:
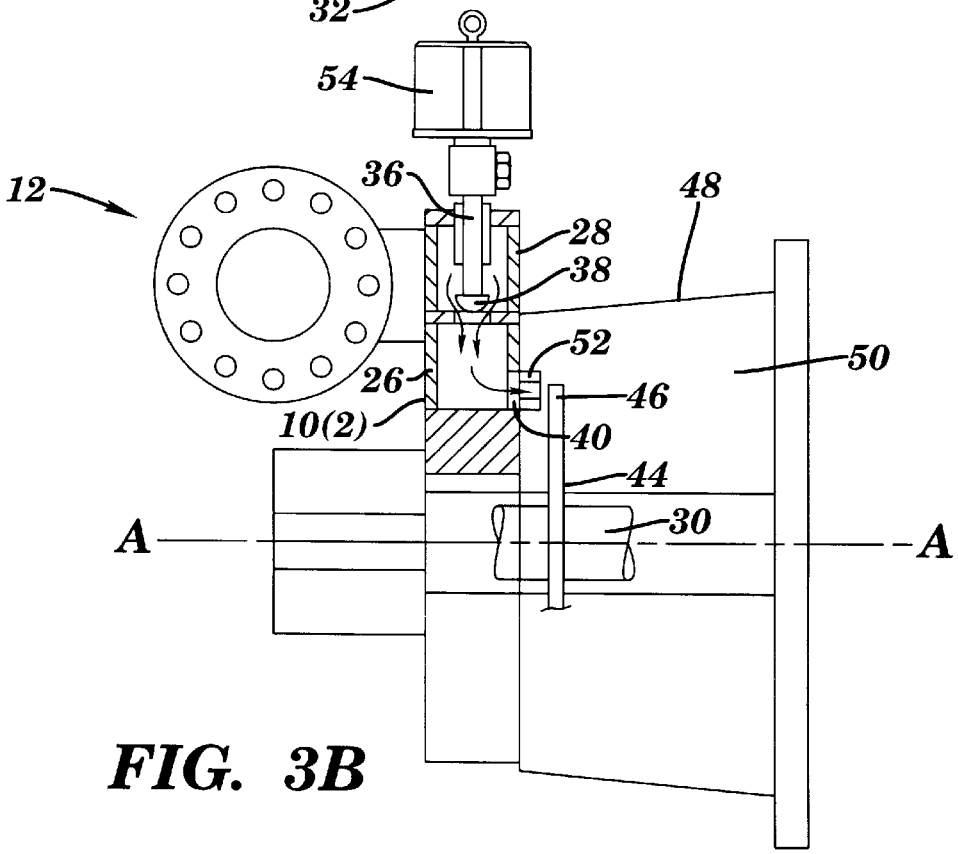
FIG. 3B is a cross-sectional view of the inlet casing in the turbine taken along line 3B—3B in FIG. 3A.
Figure 3C:
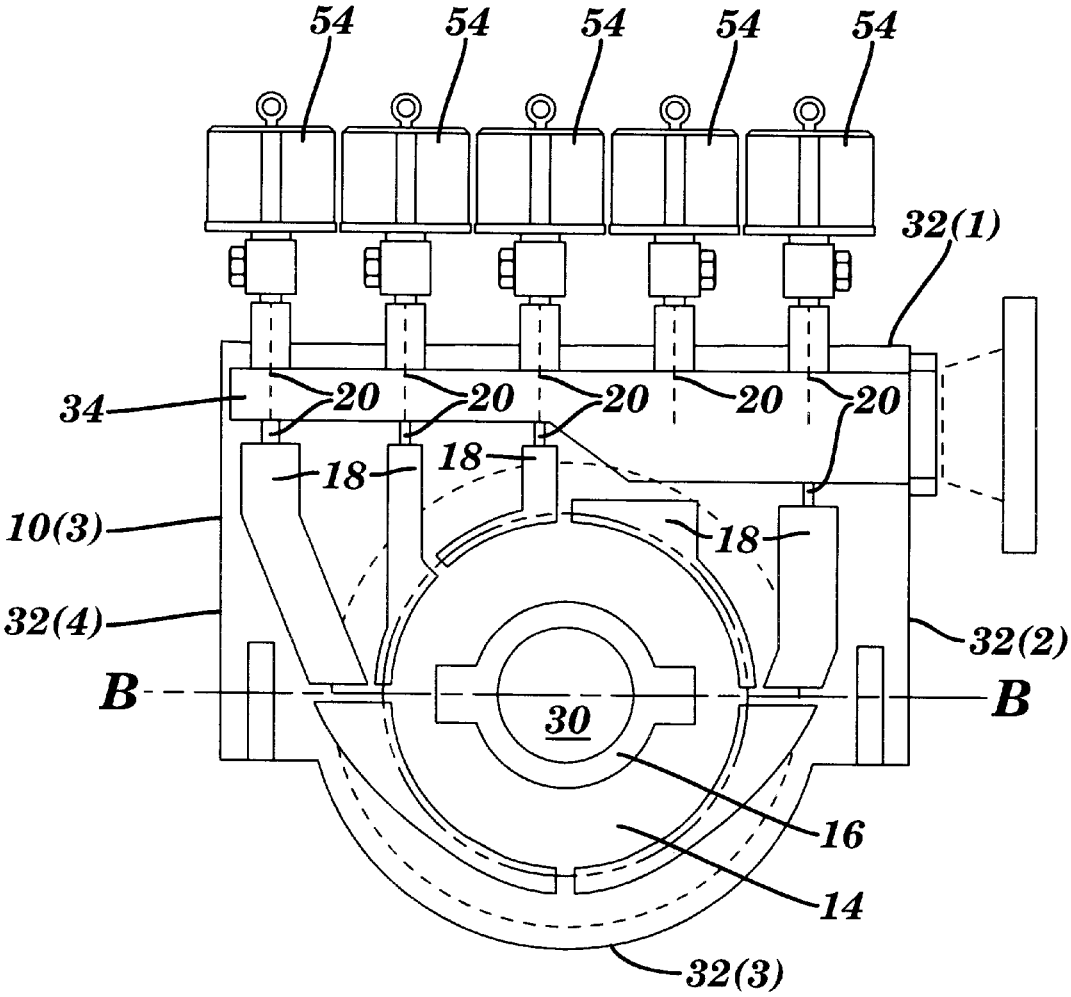
FIG. 3C is a cross-sectional view of an inlet casing in accordance with another embodiment of the present invention in a turbine.

Another one of the advantages of the invention is that the number, size, shape, and location of the distribution ports 18, and the inlet plenum 34 in the inlet casing 10 can be customized for each turbine 12. By way of example: in FIGS. IB and IC the inlet casing 10(1) for one embodiment has five distribution ports 18, which each have a different shape and only extend around a portion of the block 14 about the rotational axis A—A for partial admission to the first stage of the turbine 12. In FIG. 2A–2E, the inlet casing 10(2) for another embodiment has only three distribution ports 18, which also each have a different shape and only extend around a portion of the block 14 about the rotational axis A—A for partial admission to the first stage of the turbine 12. In FIG. 3C, the inlet casing 10(3) for another embodiment has five distribution ports 18, which each have a different shape and extend substantially around the block 14 about the rotational axis A—A for full admission to the first stage of the turbine 12. Although a plurality of distribution ports 18 are shown in these examples, the number of distribution ports 18 can vary from one to many. The inlet casing 10 can be customized for each turbine application to improve efficiency, cost and performance.

Next, an inlet plenum or passage 34 is cut into the block 14 as shown in FIG. 1C. Like the shaft opening 16 and the distribution ports 18, the inlet plenum 34 also extends through the block 14 from the upstream face 26 to the downstream face 28. Although in this particular embodiment, the inlet plenum 34 is shown extending through the block 14, the inlet plenum 34 may also be machined into the block 14 to extend in from either the upstream face 26 or the downstream face 28, but not all the way through the block 14. Again, with the present method, the size and shape of the inlet plenum 34 can be customized for each turbine 12 to improve efficiency and performance. Any technique, such as flame cutting, can be used to cut the inlet plenum 34. Although not shown, in an alternative embodiment the inlet plenum 34 does not need to be cut into the block 14. Instead, a feed tube or inlet manifold can be connected to the block 14 by bolts, welding, or other means to feed motive fluid to each of the distribution ports 18 through the connecting hole or holes 20 in place of the inlet plenum 34.

Once the inlet plenum 34 and the distribution ports 18 are cut, connecting holes or inlets 20 are cut to connect the distribution ports 18 to the inlet plenums 34 and to provide a passage for control rods 36 for the control valves 38 if used. The holes 20 are cut into the block 14 along the side surfaces 32 and extend through the inlet plenum 34 to the distribution ports 18 to form inlets or connecting holes 20 between the inlet plenum 34 and the distribution ports 18. The connecting holes 20 in the side surface 32 of the block 14 have a larger circumference than the rods 36 for the control valves 38 that are used to regulate fluid flow to each of the distribution ports 18. Typically, a valve seat 39 is located in each connecting hole 20 to control the flow of motive fluid from the inlet plenum 34 through these holes 20. Again, any technique, such as flame cutting or drilling, can be used to cut the holes 20. If the inlet plenum 34 is not cut into the block 14, then the holes 20 will extend through the side surface 32 of the block 14 directly to the distribution ports 18. In this alternative embodiment (not shown), a feed 5tube or manifold would be connected to each of the distribution ports 18 via holes 20. Although only one hole 20 is shown for each distribution port 18, each distribution port 18 could have multiple connecting holes 20 if needed or desired.

Next, the upstream and downstream cover plates 22 and 24 are attached to the upstream and downstream faces 26 and 28 of the block 14 to cover each of the distribution ports 18 and the inlet plenum 34. In this particular embodiment, each of the distribution ports 18 and the inlet plenum 34 has its own cover plates 22 and 24 on the upstream and the downstream faces 26 and 28, although other variations in the number of cover plates 22 and 24 can be used, such as one cover plate 22 for the upstream face 26 of the block 14 for all of the distribution ports 18 and inlet plenum 34 and one cover plate 24 for the downstream face 28 of the block 14 for all of the distribution ports 18 and inlet plenum 34. The cover plates 22 and 24 are attached by bolts, welding, or other suitable means to the block 14. Individual cover plates 22 and 24 for each distribution port 18 and inlet plenum 34 are preferred because they provide for thinner cover plates since they can be welded close to the edge of each distribution port 18 and inlet plenum 34.

Next, an outlet 40 from each of the distribution ports 18 and a feed opening 42 to the inlet plenum 34 are cut. In this particular embodiment as shown in FIGS. 2C and 3B, the outlets 40 are openings which are designed to direct motive fluid to a nozzle ring 52 which in turn directs motive fluid toward the first stage bucket row 46. Additionally, in this particular embodiment, the outlets 40 direct the motive fluid in an axial direction, i.e. in the same direction as the rotational axis A—A as shown by the arrows in FIGS. 2A, 2B, and 3B, although the outlets 40 could direct the motive fluid in other directions if desired. Further, in the embodiment as shown in FIG. 1C, the feed opening 42 extends through the cover plate 22 for the inlet plenum 34 to direct motive fluid into the inlet plenum 34, although the inlet opening 42 could extend through the block 14 as shown in FIG. 3C. As shown in FIG. 2C, 3A, and FIG. 3B, some additional pipe fittings may be attached to feed opening 42 if needed or desired. Although only one outlet 40 is shown for each distribution port 18 and only one feed opening 42 is shown for the inlet plenum 34, each distribution port or passage 18 could have multiple outlets 40 and the inlet plenum 34 could have multiple feed openings 42, if needed or desired.

Next, the inlet casing 10 can be cut along a line B—B shown in FIG. 1B which intersects the rotational axis A—A to split the block 14 into two sections 14(1) and 14(2) for ease of installation. The respective halves 14(1) and 14(2) of the inlet casing are positioned around shaft 30 and then are connected together by bolts, welding, or other suitable means. For turbines designed with radial segments and axial assembly, it may be unnecessary to split the inlet casing. Although the steps in this method were described in one particular order, it is readily apparent to one skilled in the art that the order in which the steps are completed does not matter. For example, the inlet plenum 34 could be cut before, at the same time, or after the distribution ports 18. Once the method steps are completed, the inlet casing 10 is ready for installation onto the turbine 12.

Referring to FIGS. 3A and 3B, the turbine 12 includes shaft 30 which extends along and rotates about rotational or first axis A—A. A first stage wheel 44 is mounted on and extends radially outward from the shaft 30 to a radially outermost periphery. A plurality of buckets 46 are secured to and around the radially outermost periphery of the wheel 44. Although only one wheel 44 shown, the turbine can have more than one wheel 44 mounted on the shaft 30, if needed or desired. A housing 48 extends around and surrounds a portion of the shaft 30 and each wheel 44 and defines a housing interior 50.

A first stationary flowpath component 52 is connected to the outlet 40 of each distribution port 18 in the inlet casing 10. In this particular embodiment, the first stationary flowpath component 52 is a nozzle ring. The nozzle ring has a plurality of passages which direct motive fluid against the buckets 46 to effect rotation of the rotor wheel. The first stationary flowpath component 52 is mounted to the inlet casing 10 adjacent the outlets 40 and also at a location so that the passages in the component 52 are axially spaced upstream of the buckets 46 of wheel 44. In this particular embodiment, the component 52 is bolted to the inlet casing 10, although other means to secure the component 52 to the inlet casing could be used such as welding.

The inlet casing 10 is fastened to the housing 48 and encloses an upstream end of the housing interior 50. In this particular embodiment, the inlet casing 10 is fastened to the housing 48 by welding, although the inlet casing 10 could be fastened to housing 48 by other means, such as by bolts.

The inlet casing 10 also includes distribution ports 18 which feeds motive fluid from the inlet plenum 34 to component 52. The holes 20 for each distribution port 18 connect the distribution port 18 to the inlet plenum 34. In the embodiment shown in FIG. 3A, the distribution port 18 are spaced from and extend about halfway around the rotational centerline A—A to feed motive fluid to a portion of the buckets 46 around the circumference of the rotor 44. This embodiment is known as a partial admission turbine 12. In another embodiment illustrated in FIG. 3C, the distribution ports 18 are spaced from and extend substantially around the rotational centerline A—A to feed motive fluid to substantially all of the buckets around the circumference of the rotor 44. This embodiment is known as a full admission turbine 12. Since the distribution ports 18 can be made relatively straight and have little axial length, motive fluid is directed to the turbine flowpath, stationary flowpath component 52 and buckets 46, with a minimum loss of energy which can occur in bends, elbows, or in swirl chambers found in prior designs.

The inlet plenum 34 which is connected to the distribution ports 18 via the holes 20, has an inlet opening 42 which receives the turbine motive fluid. A source of motive fluid, (not shown), is connected to the inlet opening 42. Holes 20 in one of the side surfaces 32 of the block 14 which extend into the inlet plenum 34 can be designed to receive the control rods 36 of the control valves 38 which regulate flow of motive fluid to each of the distribution ports 18.

In this particular embodiment, each control valve system includes a control valve actuator 54, a control rod 36, valve 38, and a valve seat 39. The control valve 38 is a plug connected to one end of the control rod 36 and is located inside the inlet plenum 34 adjacent to one of the valve seats 39 fixed in a hole 20. The other end of the control rod 36 extends up through one of the side surfaces 32 through a hole 20, and is coupled to the control valve actuator 54. In a manner well known to those skilled in the art, the control valve actuator 54 can be engaged to pull the control rod 36 out to unseat the control valve 38 from the valve seat 39. The control valve actuator 54 can also be adjusted to control the position of the control valve 38 to meter how much motive fluid is allowed to pass into the inlet passage 18. This arrangement is known as a multi-valve control arrangement. Although not shown, alternate turbine control systems with control valves external to the turbine inlet (42) may also be used.

The operation of the turbine 12 with the inlet casing 10 will be illustrated with reference to FIGS. 3A and 3B. Motive fluid, such as high pressure and temperature steam, is directed from a source of motive fluid (not shown) through the inlet opening 42 to the inlet plenum 34. Each of the control valve actuators 54 are engaged to raise one or more of the control valve 38 off of the valve seat 39 in hole 20. The motive fluid passes into the distribution ports 18 via the holes 20 and exits via the outlets 40.

The motive fluid then flows through the outlets 40 to the nozzle passages in the first stationary flowpath component 52 which direct the motive fluid towards the buckets 46 on the rotor 44. The motive fluid striking the buckets 46 causes the rotor 44 and shaft 30 to rotate about the rotational axis A—A.

Having thus described the basic concept of the invention, it will be rather apparent to those skilled in the art that the foregoing detailed disclosure is intended to be presented by way of example only, and is not limiting. Various alternations, improvements, and modifications will occur and are intended to those skilled in the art, though not expressly stated herein. These alterations, improvements, and modifications are intended to be suggested hereby, and are within the spirit and scope of the invention. Accordingly, the invention is limited only by the following claims and equivalents thereto.

What is claimed is:

1. A method for fabricating an inlet casing for a turbine comprising the steps of:

providing a block having an upstream face and a downstream face;

cutting at least one distribution port into the block, the distribution port extending towards and spaced from a shaft opening and extending through the block from the upstream face to the downstream face;

cutting at least one hole in the block to the distribution port; and attaching cover plates to the upstream and downstream faces of the block to cover the distribution port.

2. The method according to claim 1 further comprising the step of cutting an inlet plenum in the block, the inlet plenum extending through the block from the upstream face to the downstream face, wherein the hole connects the inlet plenum to the distribution port and the cover plates cover the inlet plenum.

3. The method according to claim 2 wherein the distribution port and inlet plenum are covered by a different cover plate on the upstream and downstream faces.

4. The method according to claim 2 further comprising the step of cutting at least one inlet opening in the block to the inlet plenum.

5. The method according to claim 1 further comprising the step of cutting at least one outlet in the block to the distribution port.

6. The method according to claim 1 further comprising:

cutting the shaft opening in the block from the upstream face to the downstream face; and the step of cutting the block along a line which intersects the shaft opening.

7. The method according to claim 1 wherein the distribution port is cut to be spaced from and to extend around a portion of a rotational axis.

8. The method according to claim 1 wherein the distribution port is cut to be spaced from and to extend substantially around a rotational axis.

9. A method for fabricating an inlet casing for a turbine comprising the steps of:

providing a block having an upstream face and a downstream face;

cutting at least one distribution port into the block, the distribution port extending through the block from the upstream face to the downstream face;

cutting an inlet plenum in the block extending through the block from the upstream face to the downstream face, the inlet plenum spaced from the distribution port;

cutting a shaft opening in the block from the upstream face to the downstream face;

cutting at least one hole in the block to connect the inlet plenum to the distribution port; and attaching cover plates to the upstream and downstream faces of the block to cover the distribution port and the inlet plenum.

10. The method according to claim 9 wherein the distribution port and the inlet plenum are covered by a different cover plate on the upstream and downstream faces.

11. The method according to claim 9 further comprising the step of cutting at least one inlet opening in the block to the inlet plenum.

12. The method according to claim 9 further comprising the step of cutting at least one outlet in the block to the distribution port.

13. The method according to claim 9 further comprising cutting the block along a line which intersects the shaft opening.

14. An inlet casing for a turbine comprising:

a block having an upstream face and a downstream face;

a shaft opening extending from the upstream face to the downstream face of the block;

at least one distribution port which extends at least partially through the block from either the upstream or the downstream face, wherein the cross-sectional size of the distribution port is substantially the same as the distribution port extends through the block from either the upstream or the downstream face;

at least one hole to the distribution port; and at least one cover plate attached to the block to cover the distribution port.

15. The inlet casing according to claim 14 further comprising an inlet plenum extending at least partially through the block from either the upstream or the downstream face, wherein the hole connects the inlet plenum to the distribution port and the cover plate covers the inlet plenum.

16. The inlet casing according to claim 15 wherein the distribution port and the inlet plenum are covered by a different cover plate.

17. The inlet casing according to claim 15 further comprising at least one inlet opening in the block for the inlet plenum.

18. The inlet casing according to claim 14 wherein there are a plurality of distribution ports, the distribution ports being spaced from and extending around a portion of the shaft opening.

19. The inlet casing according to claim 14 wherein there are a plurality of distribution ports, the distribution ports being spaced from and extending substantially around the shaft opening.

20. A turbine comprising:

a block having an upstream face and a downstream face, the block having a shaft opening extending from the upstream face to the downstream face along a first axis;

a shaft extending through the shaft opening along the first axis;

at least one distribution port which extends towards the shaft opening and through the block from the upstream face to the downstream face, the distribution port having an outlet;

an inlet plenum extending through the block from the upstream face to the downstream face, the block having at least one hole connecting the inlet plenum to the distribution port;

at least one upstream cover plate attached to the upstream face of the block to cover the distribution port and the inlet plenum;

at least one downstream plate attached to the downstream face of the block to cover the distribution port and the inlet plenum;

a control valve positioned over the hole, the control valve moveable from a position covering the hole to another position exposing the hole;

a control valve actuator to move the valve;

at least one wheel on the shaft, the wheel having a plurality of buckets circumferentially arrayed about a rotor;

a nozzle ring connected to the block and positioned between an outlet from the distribution port and the buckets; and a housing to encase the turbine.

21. The turbine according to claim 20 wherein the distribution port and the inlet plenum are covered by a different cover plate on the upstream and downstream faces.

22. The turbine according to claim 20 wherein the distribution port is spaced from and extends around about a portion of the shaft opening.

23. The turbine according to claim 20 wherein the distribution port is spaced from and extends substantially around the shaft opening.

* * * * *